US007291980B2

(12) United States Patent
Fischer et al.

(10) Patent No.: US 7,291,980 B2
(45) Date of Patent: Nov. 6, 2007

(54) HIGH-PRESSURE MERCURY VAPOR DISCHARGE LAMP WITH A SPACE

(75) Inventors: Hanns Ernst Fischer, Stolberg (DE); Dieter Leers, Stolberg (DE); Bernd Engelbrecht, Landgraaf (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 125 days.

(21) Appl. No.: 10/547,593

(22) PCT Filed: Feb. 27, 2004

(86) PCT No.: PCT/IB2004/000572

§ 371 (c)(1),
(2), (4) Date: Sep. 1, 2005

(87) PCT Pub. No.: WO2004/079772

PCT Pub. Date: Sep. 16, 2004

(65) Prior Publication Data

US 2006/0152160 A1 Jul. 13, 2006

(30) Foreign Application Priority Data

Mar. 6, 2003 (EP) ..... 03100560

(51) Int. Cl.
*H01J 17/16* (2006.01)
*H01J 61/39* (2006.01)

(52) U.S. Cl. ..... 313/634; 313/573

(58) Field of Classification Search ..... 313/573, 313/491, 523, 493, 620, 634
See application file for complete search history.

(56) References Cited

FOREIGN PATENT DOCUMENTS

| | | | |
|---|---|---|---|
| DE | 38 13421 | A1 | 11/1989 |
| DE | 3813421 | A1 | 11/1989 |
| EP | 1107284 | A1 | 6/2001 |
| JP | 07240184 | A | 9/1995 |

*Primary Examiner*—Joseph Williams

(57) ABSTRACT

A high-pressure mercury vapor discharge lamp has an envelope which contains two electrodes made from tungsten and a filling in a discharge space. The filling essentially consists of mercury, rare gas, and a halogen that is free in the operating condition. The envelope further has a second space.

12 Claims, 3 Drawing Sheets

HIGH-PRESSURE MERCURY VAPOR DISCHARGE LAMP WITH A SPACE

Figure 1:
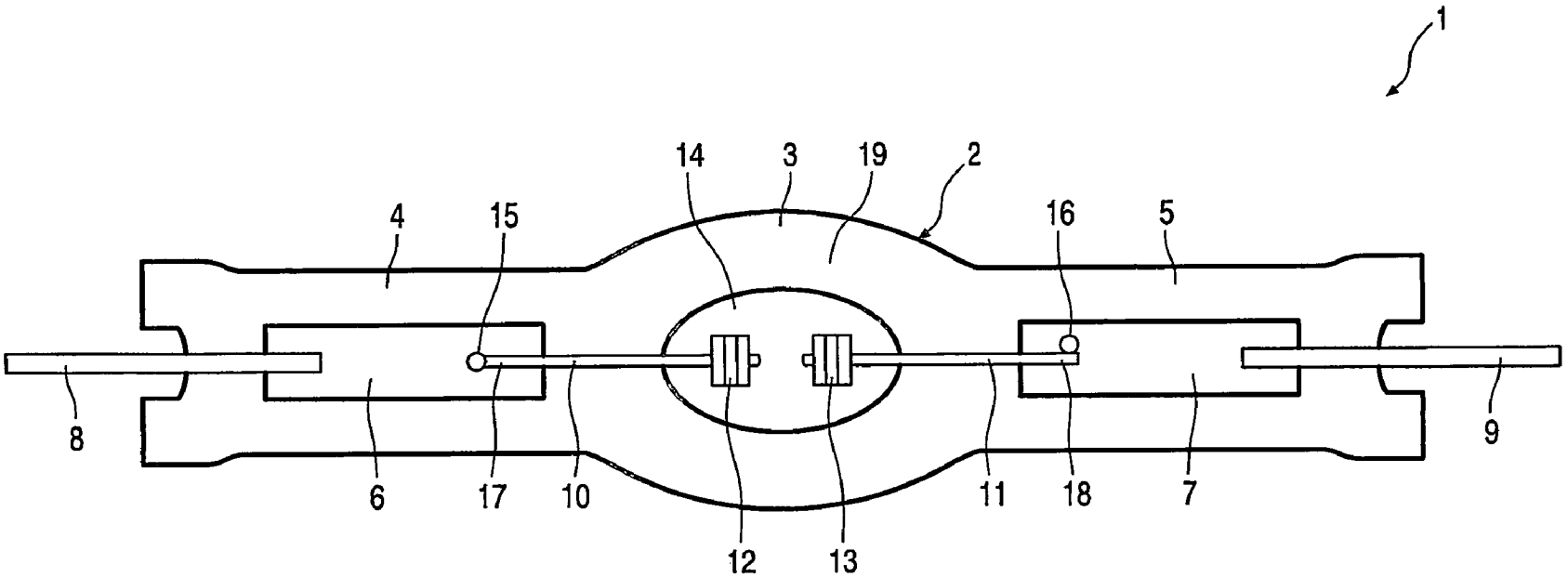

The invention relates to a high-pressure mercury vapor discharge lamp comprising an envelope made from high-temperature-resistant material, which contains two electrodes made from tungsten and a filling in a discharge space, which filling essentially consists of mercury, rare gas, and a halogen that is free in the operating condition.

High-pressure mercury vapor discharge lamps with a cyclical process of the halogen for avoiding wall blackening are known from DE 38 13 421 A1 and are used as light sources in video and data projectors. Long burning periods can be reached only if the lamps are not subject to blackening. This can be achieved by adding the halogen to the filling, which can prevent precipitation of evaporating tungsten from the electrodes on the envelope wall. The available halogen reserve, however, is lost in the course of the burning period due to the reactions with the envelope and electrode material and this collapses the halogen cycle. A filling of the lamp with a larger quantity of halogen leads to a high halogen concentration in the gas phase at the beginning of the burning time and consequently to more electrode corrosion and shorter burning period.

It is accordingly an object of the invention to ensure a balanced halogen concentration in the gas phase over a long period.

This object is achieved according to the features of claim 1. According to the invention, the envelope comprises besides the discharge space a second space, which is connected to the former. During the first burning period the mercury evaporates and collects in the second space. If the position of the space is selected suitably, part of the mercury filling will condense within the second space, which is also called hollow space, and will form liquid mercury, which does not evaporate again during the operation. A portion of the filled halogen quantity is soluble as mercury halide in this liquid mercury.

Although mercury halide does not dissolve in the mercury at room temperature, it has surprisingly shown a dissolving phase at temperatures above 200° C. Such a dissolving phase of mercury halide may be used as a storage reservoir or buffer for the halogen concentration in the gas phase in a burning lamp. In this case a dissociation pressure above this solution determines the halogen vapor pressure in the gas phase. As a result the lamp contains a halogen buffer, i.e. a liquid or solid halogen reservoir, which can provide the halogen quantity necessary for a cyclical process in case of loss of halogen from the gas phase.

Advantageously, the second space has a volume that is between 0.5% and 40%, preferably between 1% and 10% of the volume of the liquid mercury filling. The major portion of the mercury thus remains in the discharge space and cannot condense in the second space, so that the operating pressure of the lamp is maintained. Hence the volume of the reservoir is chosen to be so small that only a small portion of the entire mercury filling can condense there.

Simply put, the second space is arranged within the electrode lead-through; as a result its temperature is lower than the coldest spot of the wall of the discharge space while the lamp is on.

Advantageously, the second space is arranged at an inner end of an electrode rod or laterally of the rod. On account of the distance from the discharge space, the temperature of the reservoir is chosen such that enough mercury halide can dissolve and the dissociation pressure adjusts itself above the solution phase in a range leading to an optimum halogen transport cycle. The discharge space and the hollow space are connected to each other by capillaries or slots in order that a pressure and concentration balance can be set between both spaces. Generally, capillaries, cracks or slots arise as a result of the production process in the vicinity of the electrode rod and can be used for connecting. The lamp envelope has one or more second hollow spaces connected to the internal volume of the discharge space, also called interior space of the envelope, which has a lower temperature than the coldest spot on the inside wall of the discharge space during the operation in order that part of the mercury filling can condense there.

In lamps which are used for video and data projectors, the mercury filling is measured advantageously such that a mercury quantity of more than 0.15 mg/mm$^2$ remains in the internal volume during operation. The mercury vapor pressure in these lamps must be very high during operation if a favorable emission pressure is to be reached, which can be achieved only if the envelopes are very compact. The lamps contain mercury fillings of more than 0.15 mg/mm$^2$.

Simply put, the used halogen bromine is in a filling quantity between $10^{-6}$ and $10^{-1}$ μmole per mm$^3$, preferably between $10^{-5}$ and $10^{-2}$ μmole per mm$^3$ of the internal volumes.

These and other aspects of the invention are apparent from and will be elucidated with reference to the embodiments described hereinafter.

Figure 2:
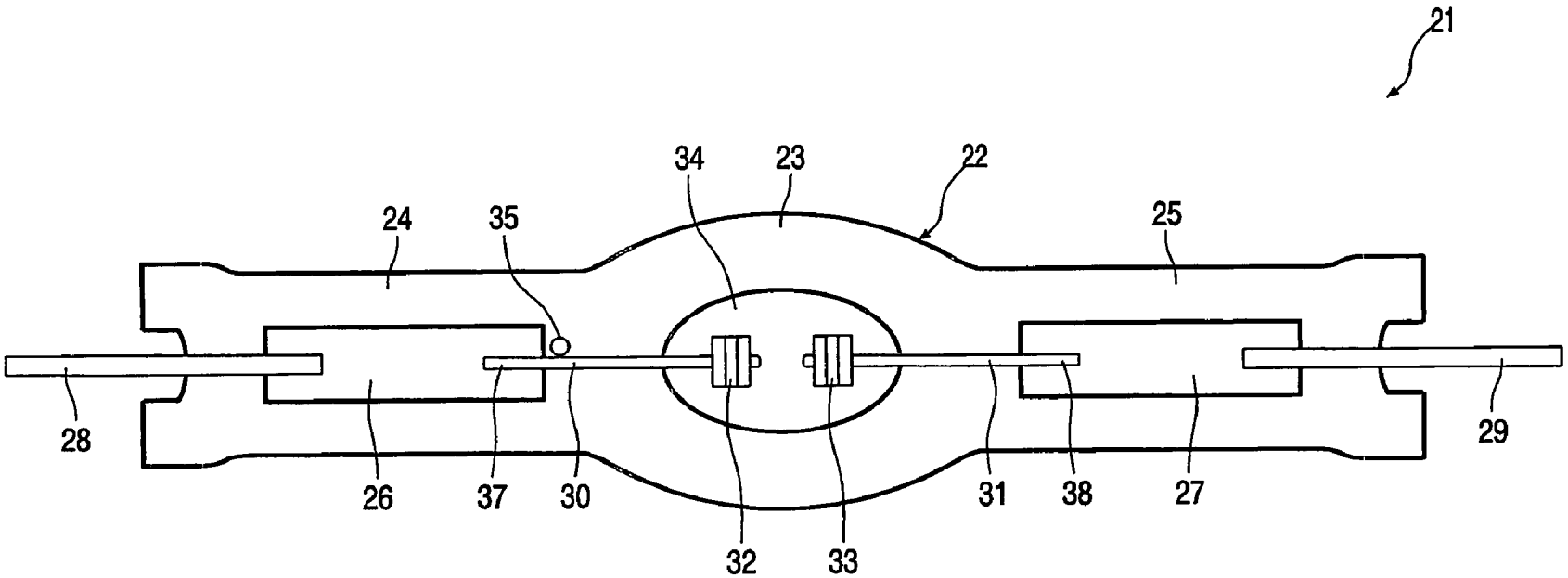
Figure 3:
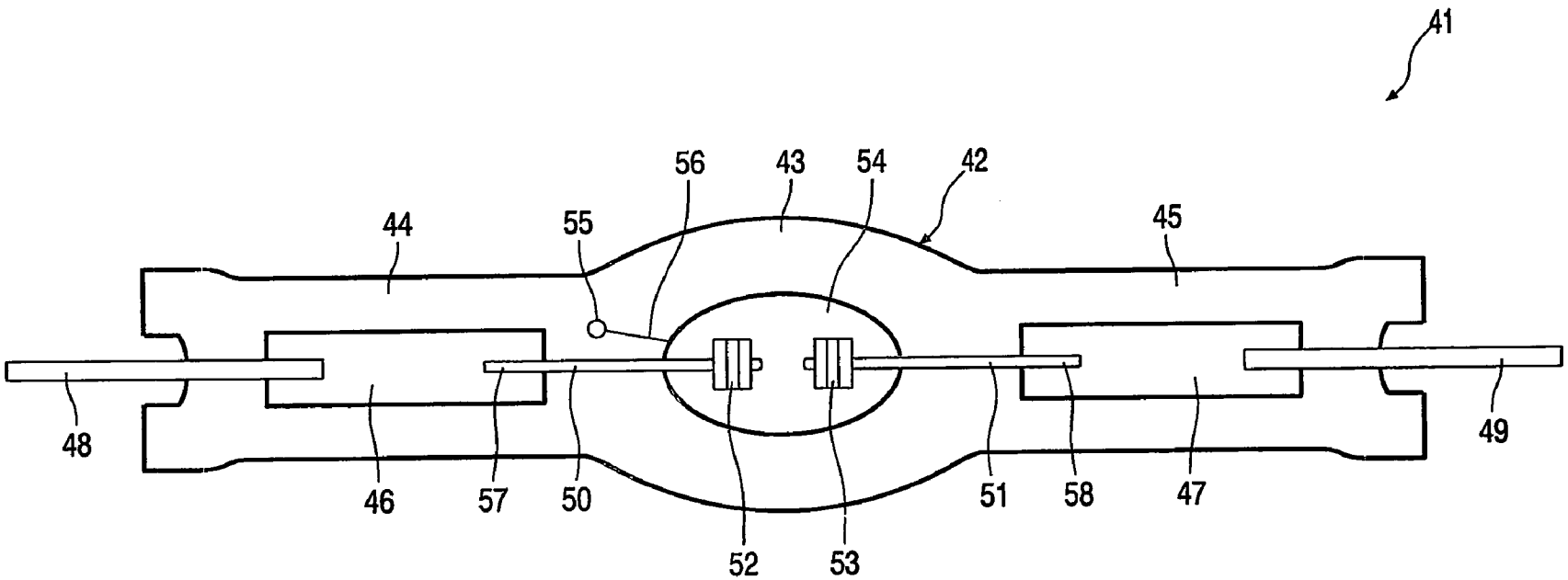

In the drawings:

FIG. 1 shows a high-pressure mercury vapor discharge lamp with two hollow spaces at ends of electrode rods in sectional top view, FIG. 2 shows a second high-pressure mercury vapor discharge lamp with a hollow space at a side of an a electrode rod in sectional top view, and FIG. 3 shows a third high-pressure mercury vapor discharge lamp with a hollow space beside an electrode rod in sectional top view.

FIG. 1 shows a high-pressure mercury vapor discharge lamp 1 made from a quartz glass envelope 2 with an ellipsoidal central part of the envelope 3 and two envelope ends 4 and 5, also called electrode lead-throughs. The electrode lead-throughs 4 and 5 contain respective molybdenum foils 6 and 7 for a vacuum-sealed, electrically conductive connection between the current supply lines 8 and 9 projecting outwards and the electrode rods 10 and 11. The electrode rods 10 and 11 project with ends 12 and 13, which form the tungsten electrodes 12 and 13, into a discharge space 14 of the central part of the envelope 3. The electrode lead-through 4, 5 has a hollow space 15, 16, which is arranged at an end 17, 18 of the electrode pin 10, 11 on the molybdenum foil 6. The hollow spaces 15 and 16 are used as reservoirs and together have a volume which constitutes less than 10% of the filled mercury quantity. The discharge space 14 is enclosed by a wall 19.

FIG. 2 shows a second high-pressure mercury vapor discharge lamp 21 made from a quartz glass envelope 22 with an ellipsoidal central part of the envelope 23 and two electrode lead-throughs 24 and 25. The electrode lead-throughs 24 and 25 contain respective molybdenum foils 26 and 27 for a vacuum-sealed, electrically conductive connection between the current supply lines 28 and 29 projecting outwards and the electrode rods 30 and 31. The electrode rods 30 and 31 project with ends 32 and 33, which form the tungsten electrodes 32 and 33, into an interior 34 of the central part of the envelope 23. The electrode lead-through 24 has a hollow space 35 which is arranged laterally against the electrode rod 30 in front of the molybdenum foil 26. The hollow spaces 35 have a volume which constitutes less than 10% of the filled mercury quantity.

FIG. 3 shows a third high-pressure mercury vapor discharge lamp 41 made from a quartz glass envelope 42 with an ellipsoidal central part of the envelope 43 and two electrode lead-throughs 44 and 45. The electrode lead-throughs 44 and 45 contain respective molybdenum foils 46 and 47 for a vacuum-sealed, electrically conductive connection between the current supply lines 48 and 49 projecting outwards and the electrode rods 50 and 51. The electrode rods 50 and 51 project with ends 52 and 53, which form the tungsten electrodes 52 and 53, into an interior 54 of the central part of the envelope 43. The electrode lead-through 44 has a hollow space 55 which is arranged beside the electrode pin 50 in front of the molybdenum foil 46. The hollow spaces 55 have a volume which constitutes less than 10% of the filled mercury quantity. At least one capillary 56 or channel leading from the hollow space 55 to the electrode rod 50 or directly to the discharge space 54 is provided.

DE 3813421 A1 describes mercury maximum-pressure lamps with a concentration of free bromine in the gas phase of between $10^{-4}$ and $10^{-6}$ μmole/mm$^3$. This range ensures an optimum halogen transport cycle. This corresponds to a necessary dissociation pressure of $HgBr_2$ of between approx. 0.4 and 40 mbar in the burning lamp. It is advantageous for stabilizing the halogen concentration in the gas phase to operate the lamp near the lower threshold for keeping electrode corrosion as small as possible.

Lamps 1, 21 as described in DE 3813421 A1 were built for a trial series and were used as light sources for video and data projectors for displaying video images, with a reservoir 15, 16 or 35 being provided at one end 17, 18 or laterally of an electrode pin 10, 11, 30. The filling comprised argon as a starting gas, mercury in a quantity of 0.25 mg/mm$^3$ internal volume, and bromine in a quantity of about $1.5\times10^{-4}$ μmole/mm$^3$. The size of the reservoir 15, 16 or 35 was selected such that that less than 10% of the filled mercury could be accommodated there. At a reservoir temperature of approx. 1000 K., the dissociation pressure was approx. 4 mbar, whereas approx 50 mbar would be expected at complete vaporization.

The lamps 1, 21 clearly showed lower tungsten transport rates and better long-time stability than corresponding reference lamps without reservoir. No appreciable decline in the bromine quantity in the gas phase was observed during a 2000 h burning period.

LIST OF REFERENCE NUMERALS

1 Mercury vapor discharge lamp
2 Quartz glass envelope
3 Central part of the envelope
4 Electrode lead-through
5 Electrode lead-through
6 Molybdenum foil
7 Molybdenum foil
8 Current supply line
9 Current supply line
10 Electrode rod
11 Electrode rod
12 Electrode
13 Electrode
14 Discharge space
15 Hollow space
16 Hollow space
17 Internal end of the electrode rod
18 Internal end of the electrode rod
19 Envelope wall
20
21 Mercury vapor discharge lamp
22 Quartz glass envelope
23 Central part of the envelope
24 Electrode lead-through
25 Electrode lead-through
26 Molybdenum foil
27 Molybdenum foil
28 Current supply line
29 Current supply line
30 Electrode rod
31 Electrode rod
32 Electrode
33 Electrode
34 Envelope interior
35 Hollow space
36
37 Internal end of the electrode rod
38 Internal end of the electrode rod
39
40
41 Mercury vapor discharge lamp
42 Quartz glass envelope
43 Central part of the envelope
44 Electrode lead-through
45 Electrode lead-through
46 Molybdenum foil
47 Molybdenum foil
48 Current supply line
49 Current supply line
50 Electrode rod
51 Electrode rod
52 Electrode
53 Electrode
54 Envelope interior
55 Hollow space
56 Capillary
57 Internal end of the electrode rod
58 Internal end of the electrode rod
59
60
61
62

The invention claimed is:

1. A high-pressure mercury-vapor discharge lamp comprising an envelope made from high-temperature-resistant material, which contains two electrodes made from tungsten and a filling in a discharge space, which filling essentially consists of mercury, rare gas, and a halogen that is free in the operating condition; wherein the envelope has a second space connected to the discharge space by a channel that does not enclose an electrode rod.

2. The high-pressure mercury-vapor discharge lamp as claimed in claim 1, wherein the second space has a lower temperature than a coldest spot inside on a wall of the discharge space during operation.

3. The high-pressure mercury-vapor discharge lamp as claimed in claim 1, wherein the second space has a volume that is between 0.5% and 40% of a volume of the mercury filling.

4. The high-pressure mercury-vapor discharge lamp as claimed in claim 1, wherein the second space is arranged inside the electrode lead-through.

5. The high-pressure mercury-vapor discharge lamp as claimed in claim 1, wherein the second space is arranged at an internal end of the electrode rod.

6. The high-pressure mercury-vapor discharge lamp as claimed in claim 1, wherein the second space is arranged laterally against the electrode rod.

7. The high-pressure mercury-vapor discharge lamp as claimed in claim 1, wherein the second space is arranged beside the electrode rod.

8. The high-pressure mercury-vapor discharge lamp as claimed in claim 1, wherein a mercury quantity of more than 0.15 mg per $mm^3$ internal volume is evaporated during operation.

9. The high-pressure mercury-vapor discharge lamp as claimed in claim 1, wherein the halogen is bromine in a filling quantity of between $10^{-6}$ and $10^{-1}$ μmole per $mm^3$ of an internal volume of the discharge lamp.

10. A lighting apparatus with the high-pressure mercury-vapor discharge lamp as claimed in claim 1.

11. The high-pressure mercury-vapor discharge lamp of claim 1, wherein the second space has a volume that is between 1% and 10% of a volume of the mercury filling.

12. The high-pressure mercury-vapor discharge lamp of claim 1, wherein the halogen is bromine in a filling quantity of between $10^{-5}$ and $10^{-2}$ μmole per $mm^3$ of an internal volume of the discharge lamp.

* * * * *